US007050064B2

(12) United States Patent
Pan et al.

(10) Patent No.: US 7,050,064 B2
(45) Date of Patent: May 23, 2006

(54) METHOD AND APPARATUS FOR DISPLAYING HIGHER COLOR RESOLUTION ON A HAND-HELD LCD DEVICE

(75) Inventors: Jun Pan, Bellevue, WA (US); Samir Abou-Samra, Vancouver (CA); Robert Champagne, Redmond, WA (US); Claude Comair, Vancouver (CA); Sun Tjen Fam, Vancouver (CA); Prasanna Ghali, Vancouver (CA); Xin Li, Issaquah, WA (US)

(73) Assignee: Nintendo Co., Ltd., Kyoto (JP)

( * ) Notice: Subject to any disclaimer, the term of this patent is extended or adjusted under 35 U.S.C. 154(b) by 16 days.

(21) Appl. No.: 10/117,115

(22) Filed: Apr. 8, 2002

(65) Prior Publication Data

US 2003/0189576 A1 Oct. 9, 2003

Related U.S. Application Data

(60) Provisional application No. 60/167,226, filed on Nov. 24, 1999.

(51) Int. Cl.
*G09G 5/02* (2006.01)

(52) U.S. Cl. ..... 345/591; 345/589; 345/600; 463/31; 463/33

(58) Field of Classification Search ..... 345/152, 345/153, 132, 149, 88, 199, 600, 534, 764, 345/593, 629, 531, 589, 591; 348/650; 463/31, 463/33; 382/162
See application file for complete search history.

(56) References Cited

U.S. PATENT DOCUMENTS 4,301,503 A * 11/1981 Frederiksen ..... 463/33
4,481,529 A 11/1984 Kerling
4,516,777 A 5/1985 Nikora
4,542,903 A 9/1985 Yokoi et al.
4,628,304 A 12/1986 Bottiau
4,823,120 A * 4/1989 Thompson et al. ..... 345/629

(Continued)

FOREIGN PATENT DOCUMENTS

EP 0 960 637 12/1999

(Continued)

OTHER PUBLICATIONS

Horizontal Blank Interrupt, Wikipedia—The Free Encyclopedia http://www.wikipedia.org/wiki/Horizontal_blank_interrupt on Aug. 28, 2003 (1 page), last modified Apr. 27, 2003.*

(Continued)

*Primary Examiner*—Matthew C. Bella
*Assistant Examiner*—Alysa N. Brautigam
(74) *Attorney, Agent, or Firm*—Nixon & Vanderhye P.C.

(57) ABSTRACT

Effective color resolution of a limited-memory color-mapped display system such as a portable liquid crystal display (LCD) handheld video game system can be increased by changing the color mapping information during active display time (e.g., during the horizontal blanking interval between rasterization of successive lines on the display). A subset of the color mapping information can be rewritten during each horizontal blanking period. A full color bitmapped source image can be converted into a color-mapped image in a way that optimizes the use of such color map updates. Since photographic and photorealistic images typically don't exhibit abrupt color changes between neighboring pixels, such techniques can result in display of a color image with very high color resolution (e.g., having as many as 2048 different colors) on hardware intended to permit simultaneous display of only a much smaller number of different colors (e.g., only 56 different colors simultaneously).

23 Claims, 16 Drawing Sheets

U.S. PATENT DOCUMENTS

| | | | | | |
|---|---|---|---|---|---|
| 4,862,392 | A | * | 8/1989 | Steiner | 345/427 |
| 4,922,420 | A | | 5/1990 | Nakagawa et al. | |
| 4,924,413 | A | | 5/1990 | Suwannukul | |
| 4,931,860 | A | | 6/1990 | Narumiya | |
| 4,979,738 | A | | 12/1990 | Frederiksen | |
| 5,095,798 | A | | 3/1992 | Okada et al. | |
| 5,134,391 | A | | 7/1992 | Okada | |
| 5,184,830 | A | | 2/1993 | Okada et al. | |
| 5,265,888 | A | | 11/1993 | Yamamoto et al. | |
| 5,300,944 | A | | 4/1994 | Shapiro et al. | |
| 5,395,112 | A | | 3/1995 | Darling | |
| 5,400,053 | A | | 3/1995 | Johary et al. | |
| 5,412,800 | A | | 5/1995 | Bril et al. | |
| 5,442,375 | A | | 8/1995 | Wojaczynski et al. | |
| 5,552,799 | A | * | 9/1996 | Hashiguchi | 345/3.2 |
| 5,556,108 | A | * | 9/1996 | Nagano et al. | 463/45 |
| 5,559,954 | A | | 9/1996 | Sakoda et al. | |
| RE35,520 | E | | 5/1997 | Darling et al. | |
| 5,734,368 | A | * | 3/1998 | Meyers et al. | 345/593 |
| 5,759,104 | A | | 6/1998 | Shirae et al. | |
| 5,785,598 | A | | 7/1998 | Hsu | |
| 5,790,096 | A | | 8/1998 | Hill, Jr. | |
| 5,793,351 | A | | 8/1998 | Leach | |
| 5,838,389 | A | * | 11/1998 | Mical et al. | 348/650 |
| 5,844,532 | A | | 12/1998 | Silverbrook et al. | |
| 5,854,620 | A | | 12/1998 | Mills et al. | |
| 5,892,939 | A | | 4/1999 | Call et al. | |
| 5,935,003 | A | * | 8/1999 | Stephens et al. | 463/31 |
| 5,959,596 | A | | 9/1999 | McCarten et al. | |
| 6,020,751 | A | | 2/2000 | Rampone et al. | |
| 6,047,373 | A | | 4/2000 | Hall et al. | |
| 6,067,098 | A | * | 5/2000 | Dye | 345/531 |
| 6,115,054 | A | | 9/2000 | Giles | |
| 6,132,315 | A | | 10/2000 | Miyamoto et al. | |
| 6,369,827 | B1 | * | 4/2002 | Pan et al. | 345/591 |
| 6,518,981 | B1 | * | 2/2003 | Zhao et al. | 345/764 |

FOREIGN PATENT DOCUMENTS

| | | |
|---|---|---|
| JP | 63-242293 | 10/1988 |
| JP | 4-49989 | 2/1992 |
| JP | 4-140791 | 5/1992 |
| JP | 4-140792 | 5/1992 |
| JP | 7-204349 | 8/1995 |
| JP | 10-137447 | 5/1998 |
| JP | 10-328408 | 12/1998 |
| JP | 11-207034 | 8/1999 |
| JP | 11-333144 | 12/1999 |

OTHER PUBLICATIONS

Computer Closet Collection, NEC Turbo Express, printed from wysiwyg://22/http://www.geocities.com/-compcloset/NECTurboExpress.htm on Sep. 28, 2000 (2 pages), copyright 1997-1999, last modified Jun. 24, 1999.

NEC Turbo Express, printed from http://www.edu.uni-klu.ac.at/-kseiner/express.html on Sep. 28, 2000 (2 pages), document date unknown.

Turbo Express FAQ, printed from http://www.gameconsoles.com/turboexp_faq.htm on Sep. 28, 2000 (18 pages), last revision of document: May 25, 1995.

Computer Closet Collection, Sega Game Gear, printed from wysiwyg://28/http://www.geocities.com/-compcloset/SegaGameGear.htm on Sep. 28, 2000 (2 pages), copyright 1997-1999, last modified Jun. 22, 1999.

The Real Game Gear FAQ, Version GG.04, Dec. 1999, printed from http://www.classicgaming.com/museum/realg-gfaq.txt on Sep. 28, 2000 (32 pages).

Computer Closet Collection, Atari Lynx, printed from wysiwyg://12/http://www.geocities.com/-compcloset/AtariLynx.htm on Sep. 28, 2000 (2 pages), copyright 1997-1999, last modified Jun. 22, 1999.

[FAQ] Atari Lynx Frequently-Asked Questions, printed from http://www.landfield.com/faqs/games/video-games/atari/lynx on Sep. 28, 2000 (16 pages), last revision of document: May 1, 2000.

Computer Closet Collection, Nintendo Game Boy/Game Boy Light, printed from wysiwyg://40/http://www.geocities.com/-compcloset/NintendoGameBoy.htm on Sep. 28, 2000 (5 pages), copyright 1997-1999, last modified Jun. 22, 1999.

Computer Closet Collection, Milton-Bradley Microvision, printed from wysiwyg://52/http://www.geocities.com/-compcloset/MiltonBradley-Microvision.htm on Sep. 28, 2000 (2 pages), copyright 1997-1999, last modified Jun. 22, 1999.

Microvision FAQ Version 0.08, copyright 1994, 1995, printed from http://www.gameconsoles.com/microvision_faq.htm on Sep. 28, 2000 (13 pages).

Computer Closet Collection, Sega Nomad, printed from wysiwyg://34/http://www.geocities.com/-compcloset/SegaNomad.htm on Sep. 28, 2000 (2 pages), copyright 1997-1999, last modified Jun. 22, 1999.

Sega Nomad Press Announcement of Aug. 22, 1995, printed from http://gamezero.com/team-0/whats_new/past/nomad.html on Sep. 28, 2000 (2 pages).

Computer Closet Collection, Tiger Game.com, printed from wysiwyg://46/http://www.geocities.com/-compcloset/TigerGameCom.htm on Sep. 28, 2000 (1 page), copyright 1997-1999, last modified Jun. 22, 1999.

Tiger Game.Com, "Low Cost, Big Games", printed from http://gamecenter.com/Consoles/Features/Pocket/ss02.html on Sep. 28, 2000 (2 pages), document date unknown.

* cited by examiner

COLOR DISPLAY GAME MACHINE

COLOR RENDER FLOW CHART

METHOD AND APPARATUS FOR DISPLAYING HIGHER COLOR RESOLUTION ON A HAND-HELD LCD DEVICE

CROSS-REFERENCES TO RELATED APPLICATIONS

Priority is claimed from the following:
provisional application No. 60/167,226 filed Nov. 24, 1999;
application Ser. No. 09/454,607 filed Dec. 7, 1999; and
application Ser. No. 09/633,357 filed Aug. 4, 2000.

STATEMENT REGARDING FEDERALLY SPONSORED RESEARCH OR DEVELOPMENT

N/A

FIELD OF THE INVENTION

The invention relates to color display devices, and more particularly to increasing the effective color resolution of a handheld display having limited color resolution. Still more particularly, the present invention relates to techniques for increasing the effective color resolution of a handheld color-mapped liquid crystal color display system such as may be found in a low-cost portable video game system.

BACKGROUND AND SUMMARY OF THE INVENTION

Now that miniature liquid crystal displays are readily available, a variety of devices using such displays have become popular. One example system that has become quite popular worldwide is Nintendo's GAME BOY COLOR® handheld video game system. The LCD Screen of GAME BOY COLOR® can display a total of 32,768 colors. However, the internal hardware that drives the GAME BOY COLOR® liquid crystal display has a much more limited color resolution in terms of the number of different colors that can be displayed simultaneously on the liquid crystal display screen.

Specifically, the GAME BOY COLOR® system is character-mapped rather than bit-mapped, and uses a color palette-based color-mapping arrangement to display the different colors of background and moving object video game characters. The internal liquid crystal display driver hardware is limited as to the number of color palettes that can be active at any one time. This has the effect of limiting the number of colors that may be displayed simultaneously on the LCD screen. For example, even though the color LCD display is capable of displaying more than 32,000 different colors, internal hardware limits the number of different colors to a maximum of 56 different colors at any particular instant in time.

This color mapping functionality of GAME BOY COLOR® provides advantages in terms of lower memory requirements (and thus lower cost) as compared systems with systems using a full-color frame buffer to allow the color of each individual display pixel to be independently specified. This trade-off is quite acceptable for fast-paced high-action video game play where color richness is not as important as color repertoire. However, for the display of photographic-quality still pictures, it would be highly desirable to achieve greater color diversity closer to what might be achieved with a full color frame buffer.

In order to display more colors on the LCD screen, we need to work around the limitation of the display system and simultaneously display as many different colors as possible. We have developed an invention to solve this problem that can be implemented on the GAME BOY COLOR® system but could be applied to any low-cost LCD display device with hardware that limits the number of simultaneously-displayable colors to less than the total number of colors the display device is capable of.

In accordance with one aspect of our invention, we display more colors by changing the color palette line by line during active display time. Such color palette updates can be accomplished by taking advantage of the horizontal blanking interval between rasterization of successive lines on the display. During each horizontal blanking period, we can rewrite half of the color palettes loaded into the active memory area. This means that we can rewrite all of the color palettes for each pair of display lines—providing a much larger total number of colors that may be simultaneously displayed on the LCD display.

In accordance with a further aspect of the present invention, we can optimize the conversion of full color bitmapped source images to color mapped images in a way that takes maximal advantage of the color mapping updates described above. For example, we can use an image subdivision process that breaks the source image up into optimal chunks corresponding to the association between color mapping data and portions of the image to be displayed. We can also use a particular subset of the display area provided by the LCD display to optimize such correspondence. A pixel averaging data-reduction technique using a closest-color color-reduction method based on Euclidean distance in 3D color space can be used to quantize the colors for the color map.

In further detail, we can convert a full-color source image into a color-mapped image suitable for display on the LCD display system using techniques that are optimized for the color palette updates described above. For example, we convert from a source image to a target image based on an image subdivision process that breaks the source image up into optimal chunks relating to the association between color palettes and image portions. We also choose to display our images within a square subset of the display area provided by the LCD display—again in order to optimize correspondence between particular image portions and color palettes. As a result, we can display a color image with very high color resolution (e.g., having as many as 2048 different colors) on hardware intended to permit simultaneous display of a much smaller number of different colors (e.g., only 56 different colors simultaneously).

In accordance with a further aspect of the invention, we use a pixel averaging data-reduction technique to convert a full color bitmapped source image into a color mapped image suitable for display on the limited-resource portable LCD display system. We use a closest-color color-reduction method based on Euclidean distance in 3D color space to pick the optimal subset of colors that results from averaging four neighboring pixel color values to provide a single averaged color. We can also use color distance to determine which of four selected palette colors we will assign to particular source image pixels. In particular, the preferred embodiment gets four colors from each 2-by-2 pixel minitile, and averages these four RGB value to get one color to represent that 2-pixel by 2-pixel minitile. This yields eight colors within a 16-pixel by 2-pixel tile. The preferred embodiment then uses a 3D color-distances calculation to get four colors out of the eight colors as a palette to represent that 16-pixel by 2-pixel tile. Once the four-color palette is obtained, the preferred embodiment uses the 3D distance calculation to reproduce the pixels using one of the four colors in that certain tile.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

These and other features and advantages provided by the present invention will be better and more completely understood by referring to the following detailed description of preferred embodiments in conjunction with the drawings of which:

FIG. 2C-1 shows example background palette write specification and write data registers;

DETAILED DESCRIPTION OF PRESENTLY PREFERRED EXAMPLE EMBODIMENTS

General Description Of An Example Prior Art Color Video Game Color System

Figure 1:
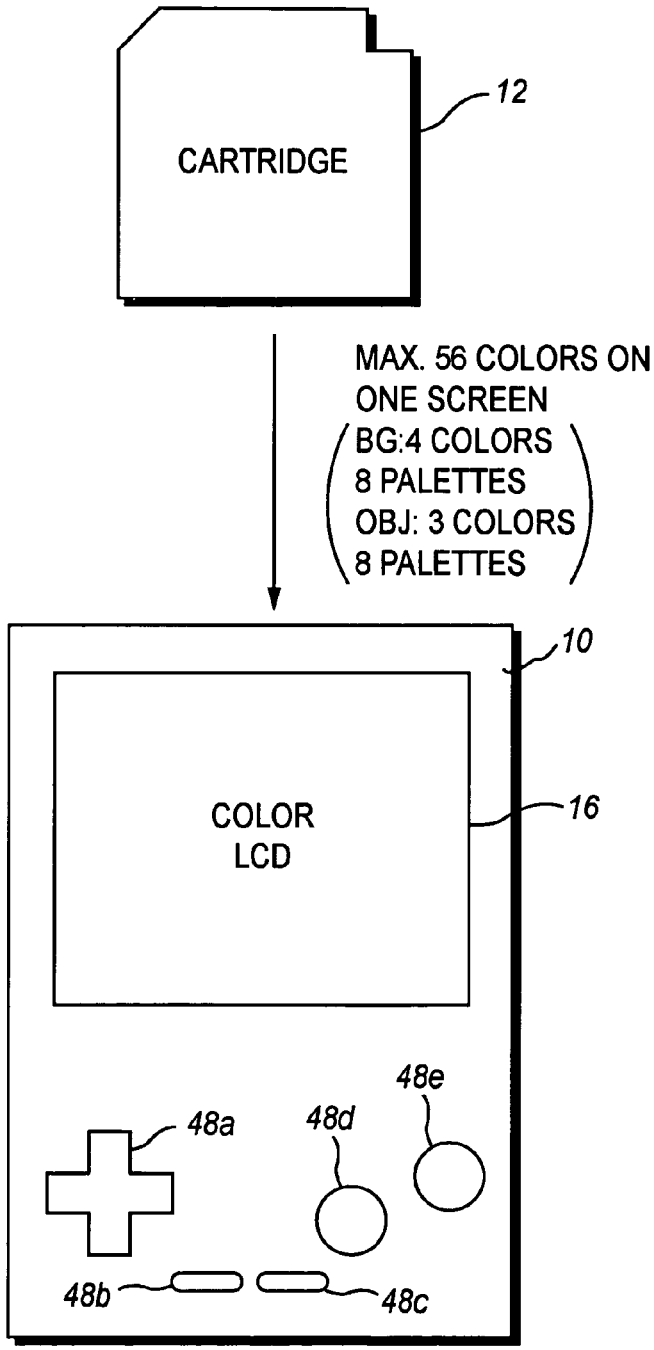
FIG. 1 (PRIOR ART)
FIG. 1 is an example schematic illustration of a handheld portable color video game system with which the present invention is especially useful.

FIG. 1 shows a prior art portable color display game system 10 known as GAME BOY COLOR® sold by Nintendo that displays game characters on a color liquid crystal display (LCD) 16. Briefly, system 10 is character-mapped, and can display moving object characters and background characters. System 10 generates color information for display on LCD display 16 through use of a color mapping arrangement based on color palettes. For background characters, each color palette comprises four colors selected from among the total number of 32,768 colors that LCD display 16 is capable of displaying. Background (BG) graphics can use 8 palettes, i.e., a total of 32 different colors. Moving objects (sprites, or OBJ) can use another 8 palettes, but these moving object palettes can provide only 3 colors per palette for a total of 24 different colors. Thus, it is typical that a GAME BOY COLOR® display screen will display 56 colors simultaneously out of the total repertoire of 32,768 possible colors.

In more detail, system 10 accepts a cartridge-based memory device 12 that supplies a particular video game or other program to be executed by system 10. Different games or other applications can be played by inserting different cartridges 12. System 10 includes a variety of operating keys 48*a*–48*e*. The operating key 48*a* is used to instruct movement of a game character displayed in the color LCD 16 in four directions, that is, upward, downward, right and left. The operating key 48*b* is a select key that is used for, for example, game mode selection and the like. The operating key 48*c* is a so-called start key that is used to start playing the game or temporarily stop the progress of the game. The operating keys 48*d*, 48*e* are push-button switches. By operating the operating keys 48*d*, 48*e*, it is possible (depending on the particular game being played) to display various motions of the game characters displayed on the color LCD 16, for example, weapon use, a jump and the like. The operating keys 48*a*–48*e* are disposed in a forward surface of the color display game machine 10 as shown in FIG. 1, and system 10 responds to operation of these keys 48 in real time to produce corresponding character and background motion on display 16. Audio output is provided through connector 54, amplifier 56, speaker 58 and device 62.

Figure 2:
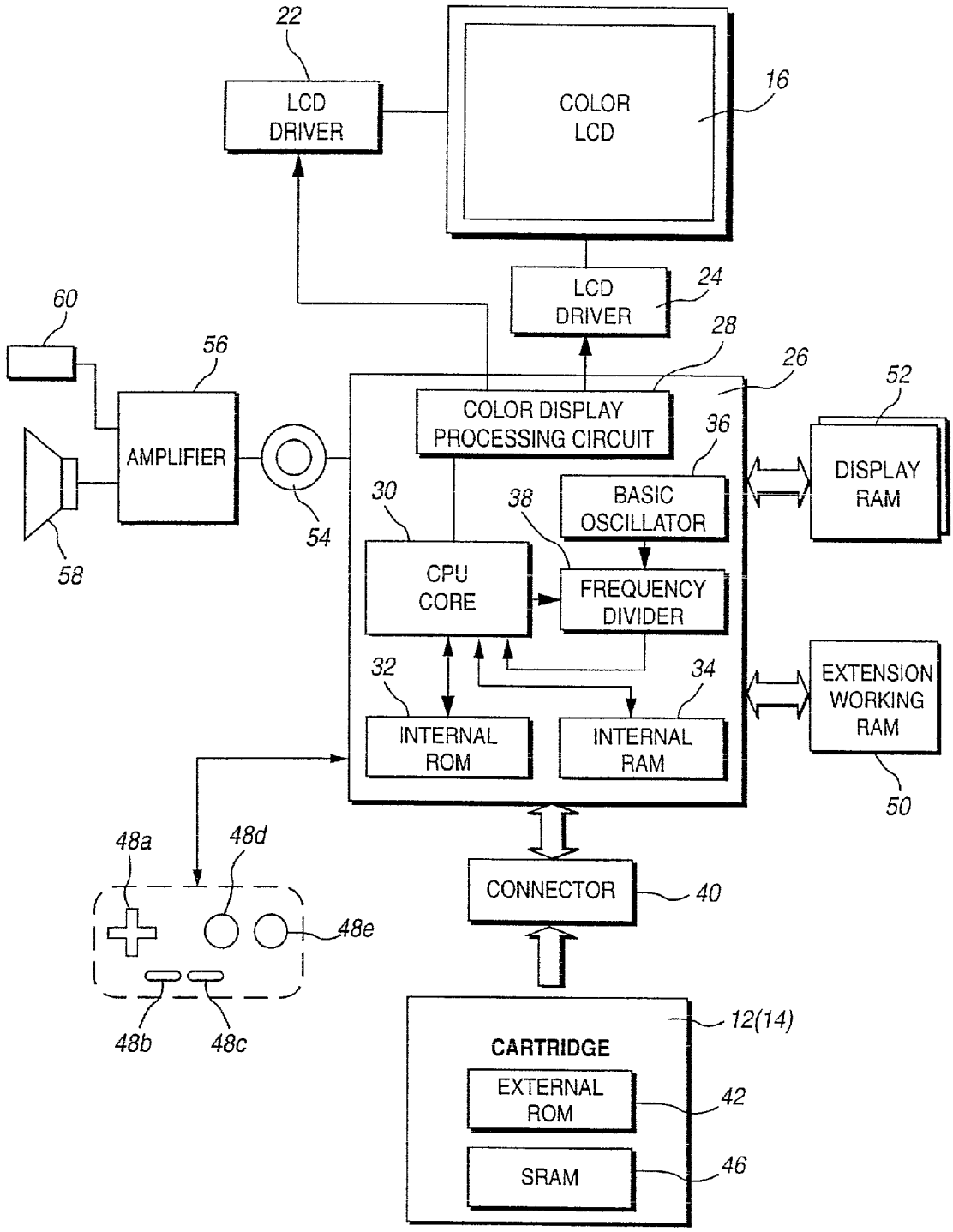
FIG. 2 (PRIOR ART)
FIG. 2 is an example schematic block diagram of the FIG. 1 system.

FIG. 2, a prior art block diagram of system 10, shows the color display game system 10 including color LCD 16 provided as a dot matrix display. The color LCD 16 is driven by LCD drivers 22, 24 to display color images. The LCD driver 22 selectively drives, for example, the rows of the LCD 16 dot matrix, and the LCD drivers 24 selectively drives, for example, the columns of the LCD dot matrix. The LCD drivers 22, 24 are supplied with color image signals from a color display processing circuit 28 included in a CPU 26.

The CPU 26 further includes a CPU core 30 and a color display processing circuit 28. The CPU core 30 is connected to an internal ROM 32 and an internal RAM 34. The CPU 26 further includes a basic quartz crystal oscillator 36 which supplies an oscillating signal to a programmable frequency divider 38. The programmable frequency divider 38 divides the oscillating signal from the basic oscillator 36 in accordance with frequency division data from the CPU core 30, and supplies a divided signal as a clock of the CPU core 30 at a nominal speed of 2.10 MHz.

A connector 40 is connected to the CPU 26 by an appropriate bus. The cartridge 12 is selectively attached to the connector 40. Cartridge 12 includes an external ROM 42 and an SRAM 46. ROM 42 stores video game program instructions and data. The SRAM 46 of each cartridge is used to store backup data of the game.

In accordance with the game program and character data supplied from the cartridge 12 and the controller data from the operating keys 48*a*–48*e*, the CPU 26 executes data processing and writes display data into a display RAM 52, using an extended RAM 50 when necessary. Display RAM 52 has, as a whole, a storage area that is greater than the display area of the color LCD 16, which enables scrolling display upward and downward and/or rightward and leftward in the screen of the color LCD 16.

Figure 2A:
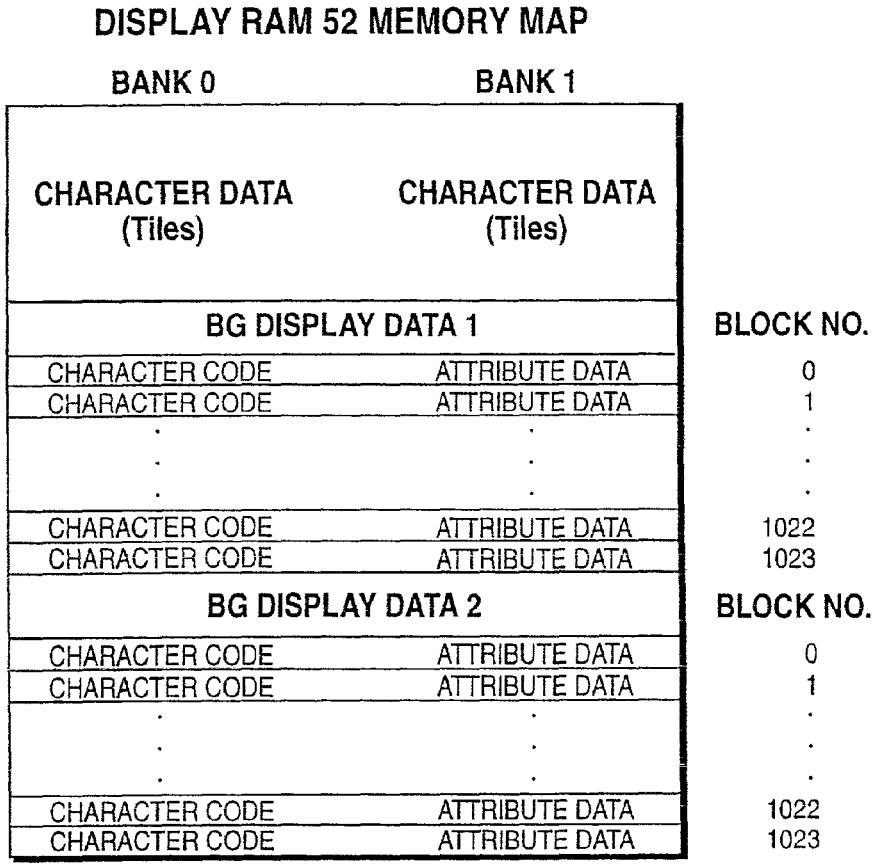
FIG. 2A (PRIOR ART)
FIG. 2A is an example memory map for the FIG. 2 system display RAM.

Prior art FIG. 2A is an example memory map of display RAM 52. The display RAM 52 may be divided into two banks each of which includes two display memories. In this example, display RAM 52 performs a character mapping function, i.e., it stores character "stamps" or "tiles" that are mapped to display 16 in accordance with character codes also stored in display RAM 52. In this example, the tiles are each defined as a 64-dot area formed as 8×8 pixels of color LCD display 16. As shown in prior art FIG. 2B map of the display range of the LCD display, LCD display 16 is 160 pixels wide and 144 pixels high, and can therefore display 20×18=360 8-by-8 pixel background tiles simultaneously.

Figure 2B:
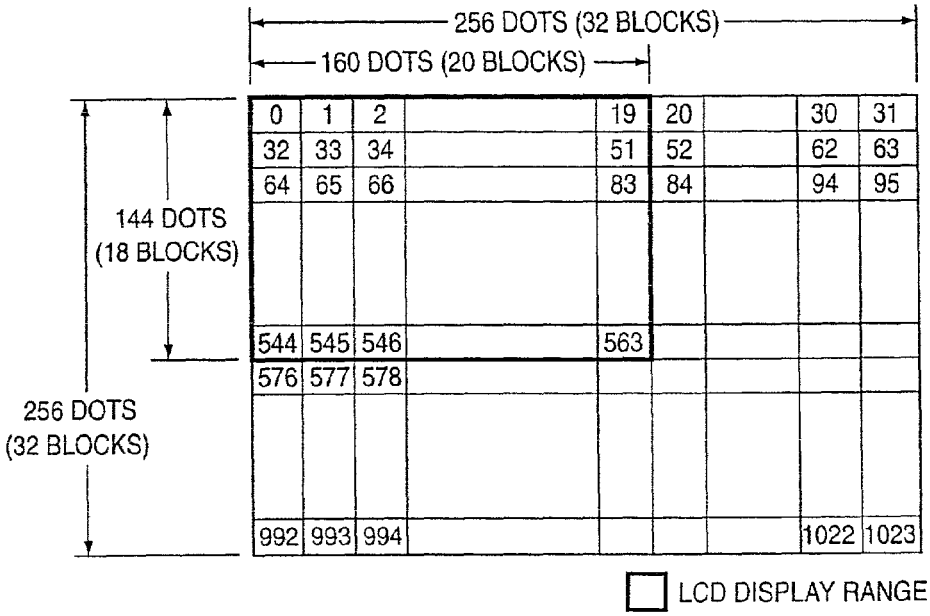
FIG. 2B (PRIOR ART)
FIG. 2B is an example background character map for the FIG. 2 system.

In this example, the tile data for the background characters is written into display RAM 52, and character code/attribute data information used to character-map this tile data onto the LCD 16 display space is also written into the display RAM 52. As shown in FIG. 2B, display memory 52 may have a storage capacity corresponding to a number (1024) of tiles that is considerably greater than the number (360) of tiles simultaneously displayable by the color LCD 16 to allow smooth scrolling of the 20×18 tile "window" comprising LCD display 16 anywhere within a 32×32 tile character map.

In this example system, the color of a particular pixel that is displayed on display 16 is specified by a color mapping process. Taking the background characters as an example, the background character data stored in display RAM 52 includes attribute data that is specified on a character-by-character basis. This attribute data includes color palette designating data that selects one of eight color palettes stored in internal RAM 34 for the background characters. Each of these eight color palettes for background data specifies four different colors for a total of 32 background character colors active at any one time. The tile data selects which of the four colors is to be displayed at any particular pixel of display 16. Similarly, the moving object character data stored in a moving object data area of the internal RAM 34 includes gradation data (4 gradations), coordinate data, character codes and attribute data for the individual object characters OBJ0–OBJn. The attribute data includes moving object color palette designating data designating one of eight color palettes to be used that internal RAM 34 stores for the object characters. Each of these eight color palettes for the object characters specifies three different colors for a total of 24 active moving-object colors at any one time.

Figure 2C:
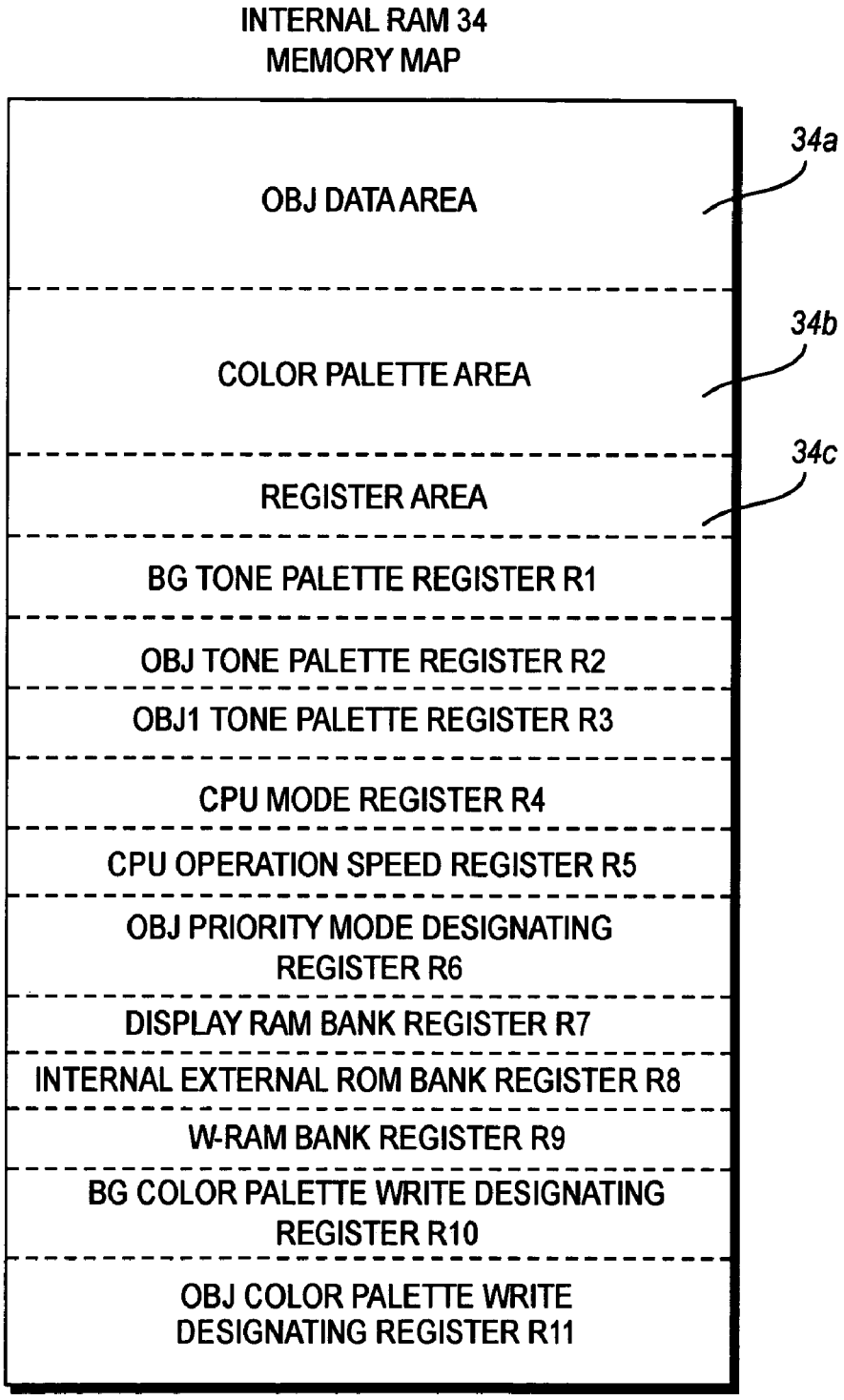
FIG. 2C (PRIOR ART)
FIG. 2C is an example memory map for the FIG. 2 internal RAM.
Figures 1, 2C:
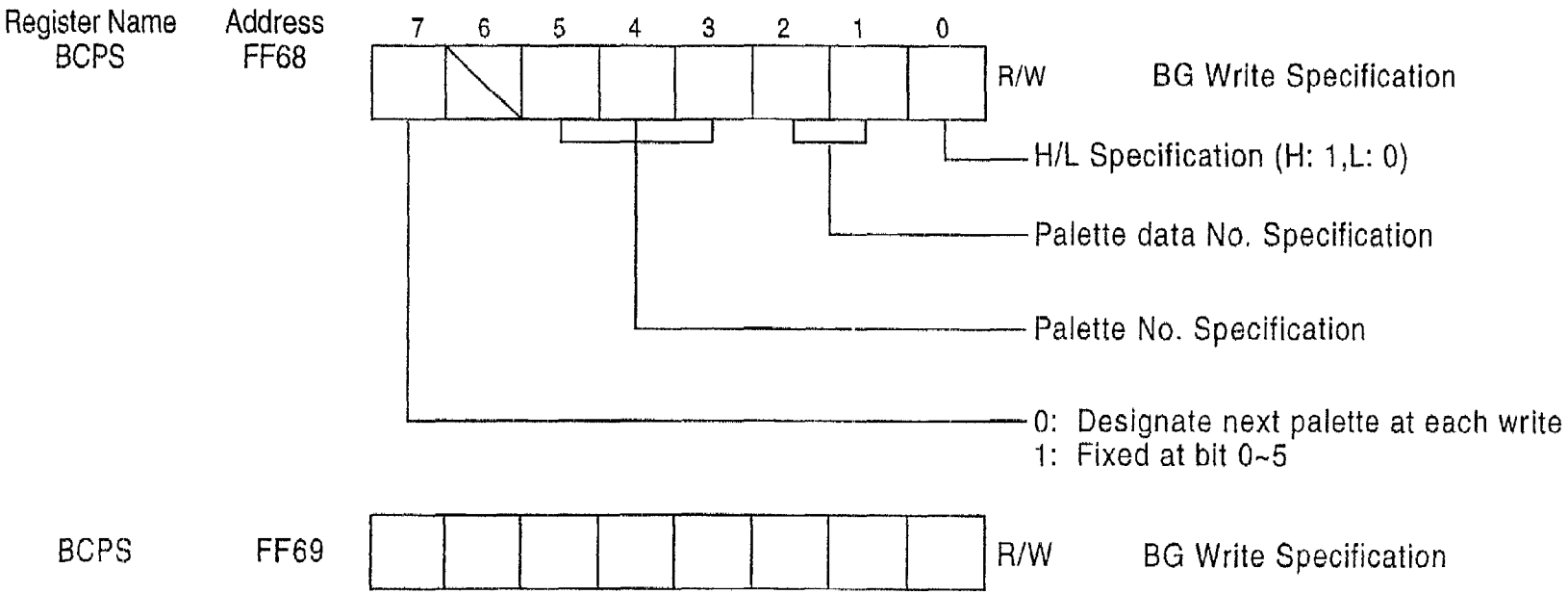
FIG. 2C-1 (PRIOR ART)

Prior art FIG. 2C shows a memory map of the internal RAM 34. Internal RAM 34 includes an object data area 34*a* that stores the moving object tiles, gradation data (4 gradations), coordinate data, character codes and attribute data for the individual object characters OBJ0–OBJn; a color palette area 34*b;* and a register area 34*c* including a number of operating registers. These registers include a background color palette write designating register R10 and a moving object color palette write designating register R11. System 10 obtains the color information for display on LCD display 16 from color palette area 34*b*. Writing data to a color palette is accomplished using the write specification register and the write data register. In example system 10, a program executing on processor 26 cannot directly access the color memory space—it can just write a address to the specification register and then write the data to the data register to change the color palettes one by one.

In more detail, the write address is specified in the least significant 6 bits of the write specification register (see FIG. 2C-1). When data are written to the write data register, the data are written to the address specified in the write specification register. At this time, if a "1" is set in the most significant bit of the write specification register, the write address is automatically incremented, designating the next address. (The next address is read from the least significant 6 bits of the write specification register.)

Figure 2D:
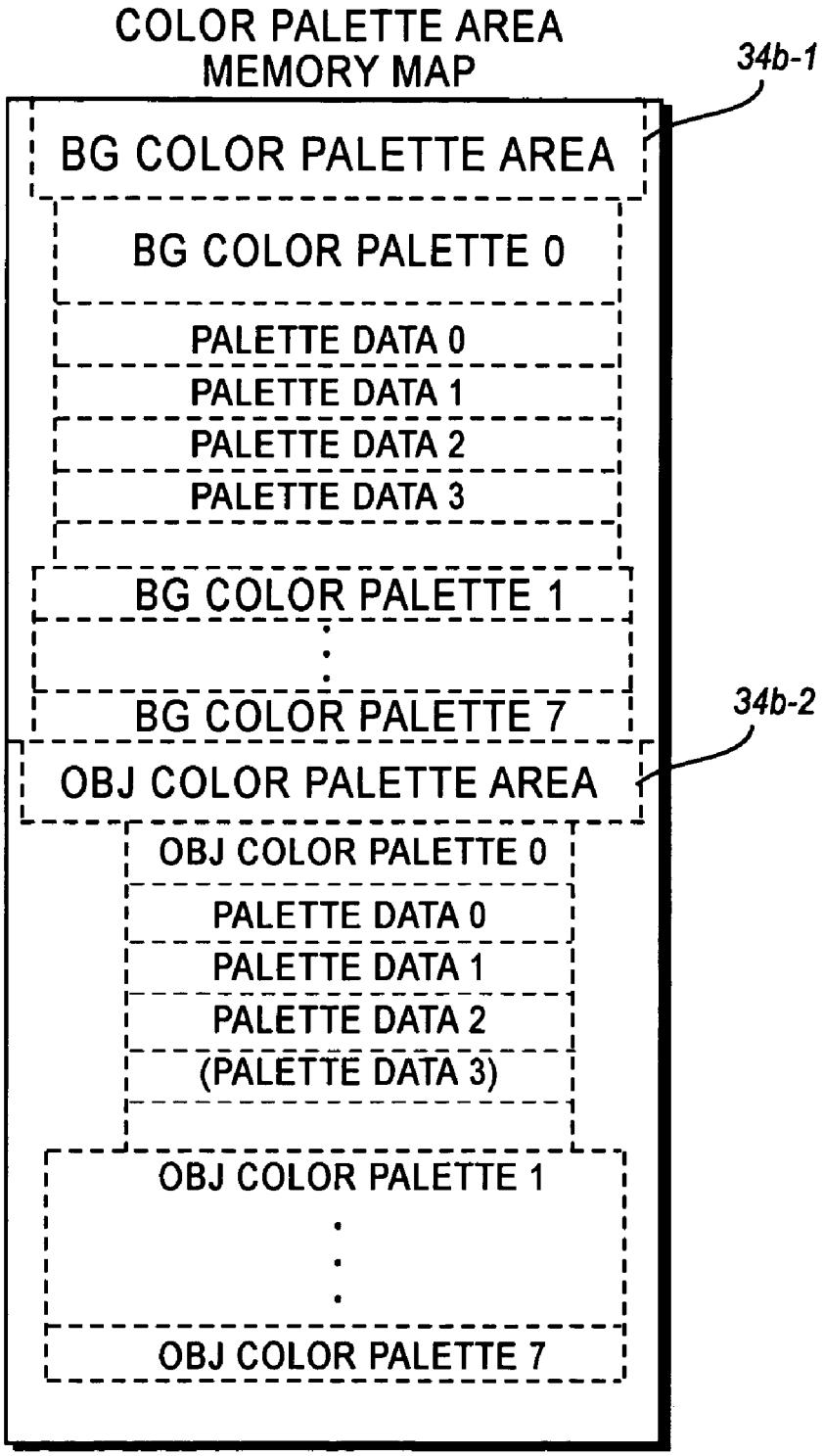
FIG. 2D (PRIOR ART)
FIG. 2D is an example memory map for the FIG. 2 system color palette area.

Prior art FIG. 2D shows an example memory map for color palette area 34*b*. The color palette area 34*b* includes a background (BG) character color palette area 34*b*-1 and a moving object (OBJ) character color palette area 34*b*-2. The BG color palette area 34*b*-1 stores eight color palettes, that is, BG color palettes 0–7, each of which specifies four colors as determined by palette data 0–3. The OBJ color palette area 34*b*-2 stores eight color palettes, that is, OBJ color palettes 0–7, each of which specifies three colors as determined by palette data 0–2. Each palette data field is 2-bytes (16-bits) long and indicates a single color out of the approximately 32K colors LCD display 16 is capable of displaying.

In operation of system 10, hardware circuits within the color display processing circuit 28 display each background (BG) character on the color LCD 16 by using the BG color palette designated by the color palette designating data included in the attribute data stored in display RAM 52; and displays each object (OBJ) character on the color LCD 16 by using the OBJ color palette designated by the color palette designating data included in the OBJ data stored in the internal RAM 34.

Figure 2E:
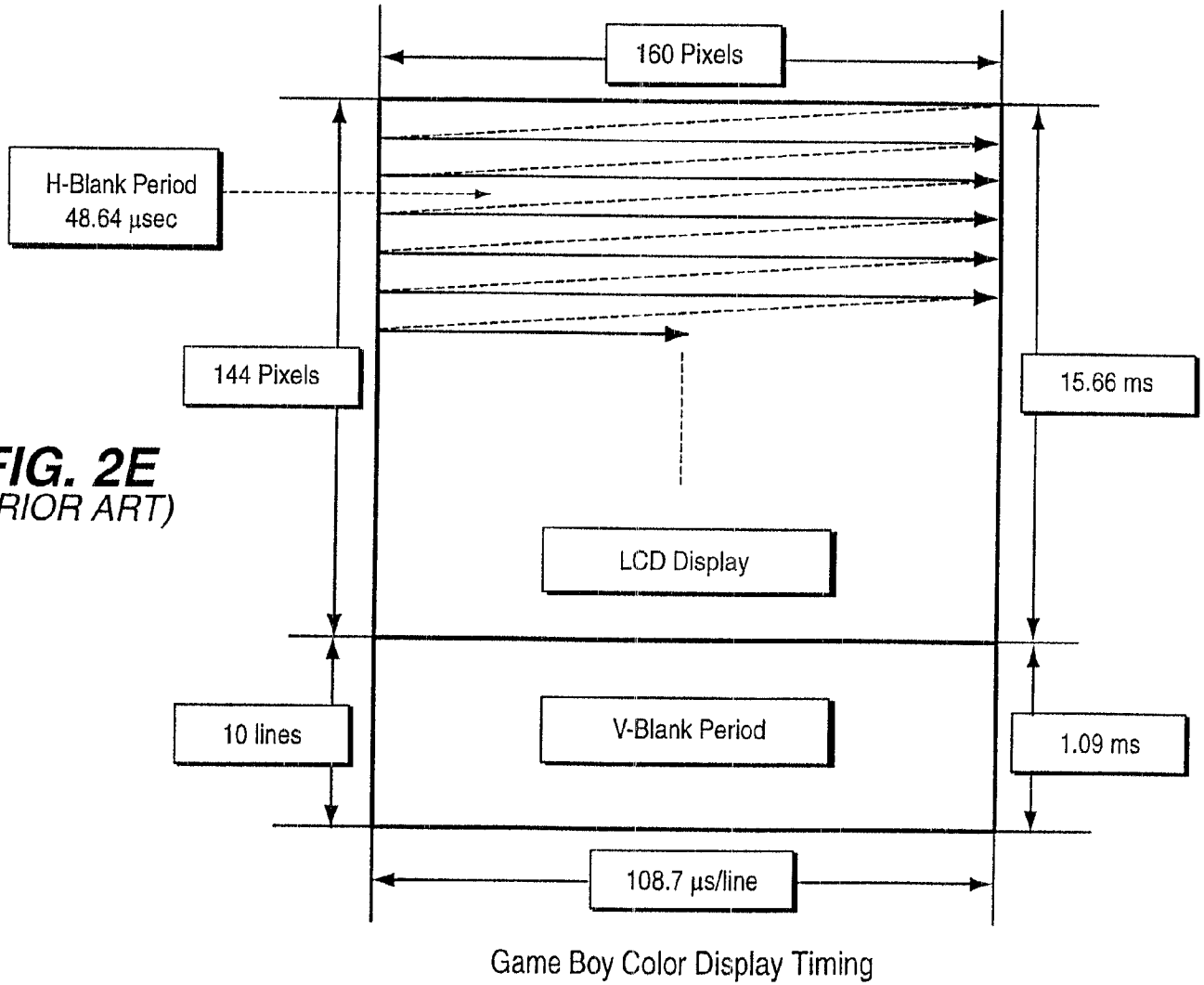
FIG. 2E (PRIOR ART)
FIG. 2E is an example display timing diagram for the FIG. 2 system.

Prior art FIG. 2E shows the raster display timing for system 10. The display drivers 22, 24 refresh the LCD display 16 once every 16.75 ms. The duration of the vertical blanking (retrace) period between frames is 1.09 ms, leaving 15.66 ms for active display time. During this 15.66 ms, system 10 displays 144 lines—meaning that each line takes 108.75 microseconds for display. The duration of the horizontal blanking period ("H-blank") between lines is 48.64 μ sec maximum. If CPU 26 is operating at 2.10 MHz, this means that CPU can complete about 110 cycles during each horizontal blanking period. System 10 can be set to generate an interrupt at every horizontal blanking interval, and at every vertical blanking interval. Generally, new color palette information is written into internal RAM 34 during the vertical blanking interval, and remains unchanged throughout the line scanning process within a given frame. More details concerning the structure and operation of system 10 may be found, for example, in Japanese Patent Application No. 10-145620 filed May 27, 1998.

Increasing the Number of Different Colors Simultaneously Displayed by Display 16

Figure 3:
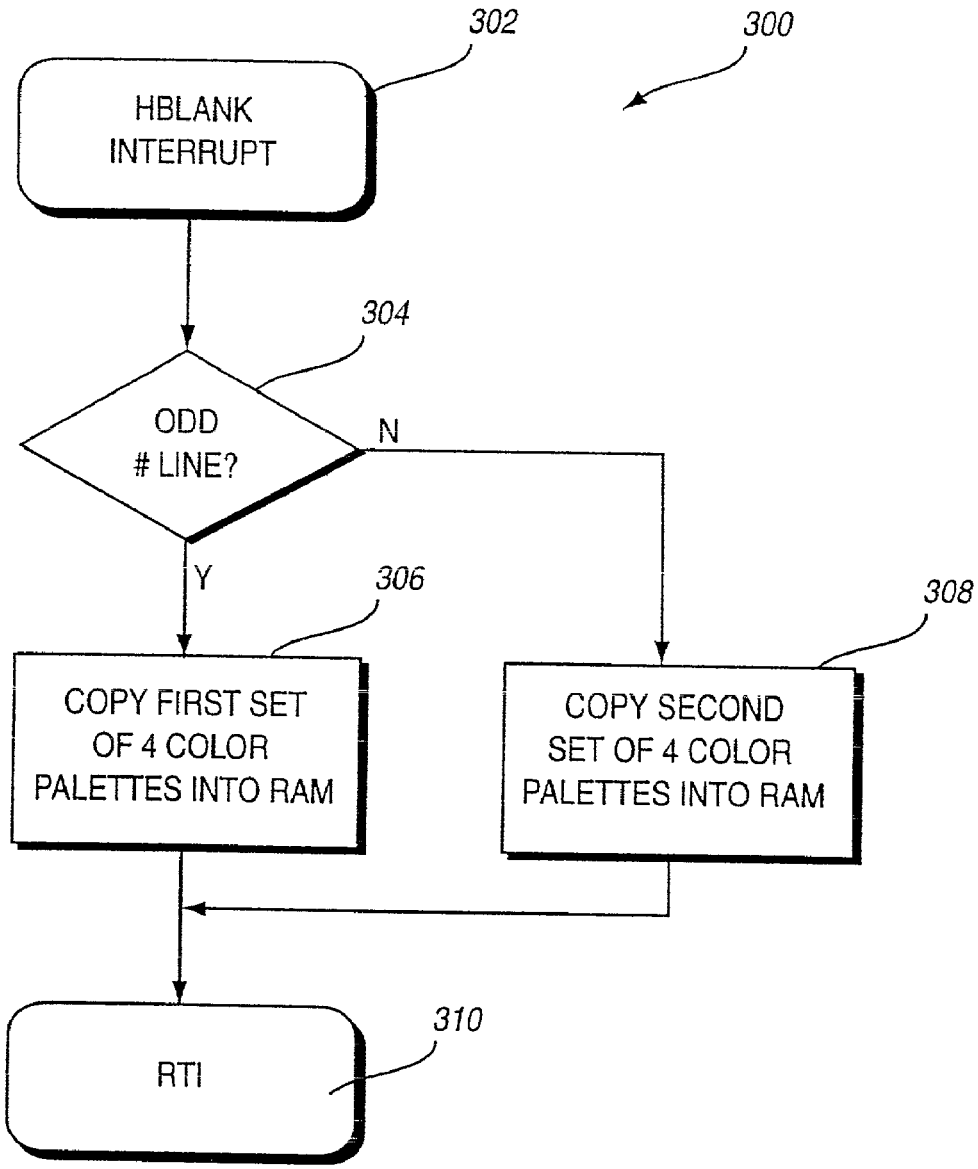
FIG. 3 is a flowchart of an example horizontal blanking interval interrupt handler provided in accordance with the present invention.

FIG. 3 shows an example interrupt handler updating process provided in accordance with a presently preferred example embodiment of the present invention. Interrupt handler 300 is particularly suitable for use with the prior art handheld video game system 10 shown in FIGS. 1 and 2A–2E and described above, although it could also be used on other low-cost handheld color display systems using color mapping. In order to display more colors on display 16, interrupt handler 300 changes the active color palette data line-by-line during the horizontal blanking portions of active display time. As explained above, CPU 26 can complete about 110 operating cycles during any given 48.64 μ sec horizontal blank period. During this short horizontal blanking time period corresponding to a single display line, we have enough time for CPU to update (rewrite) four background color palettes in RAM 34 with new data. This means that we can update all eight background color palettes every 2 horizontal blanking periods.

To change 8 new paleffes during two successive H-blank periods, the preferred embodiment writes the first 4 palettes at the first H-blank and writes the next 4 palettes during the 2nd H-blank period. Because every H-blank only gives enough time to change 4 palettes, after first H-blank the first 4 palettes can be changed but palettes 5,6,7,8 still remain the previous paleffes. After the 2nd H-blank, all 8 new paleffes have been changed.

FIG. 3 shows an example interrupt handler updating process. In response to an interrupt indicating that the horizontal blanking interval has begun (FIG. 3, block 302 ), interrupt handler 304 determines (e.g., by looking at the least significant bit of a line counter or by checking a toggling line indicator flag) whether the current line is an odd line or an even line (block 304 ). Interrupt handler 304 updates a first set of four of the eight background color palettes during the horizontal blanking period for every other line (e.g., every odd numbered line) (block 306 ) by writing to the appropriate address and data registers, and similarly updates the other four background color palettes during the other horizontal blanking periods (e.g., corresponding to every even numbered line; block 308 ). Interrupt handler returns ("RTI" block 310 ) close to the end of the horizontal blanking interval to ensure that there is no attempt to rewrite the color palette data during active line scanning. Through this dynamic updating of the color palette information, we can completely change the background color palette information at the rate of every other line.

The coding of blocks 306, 308 must be done carefully to optimize efficiency. We prefer to code these "copy" blocks using assembly language programming for maximum efficiency (i.e., to reduce to a bare minimum the number of CPU cycles required). Using assembly code to read color data and write to palette register will spend some CPU time. A common way that one might think of coding copy blocks 306, 308 is as follows:

```
        LD    B, COUNTER
        LD    C, PALETTE_REGISTER
        LD    HL, COLOR_DATA_ADDRESS
__LOOP
;
        LD    A, (HLI)        ; 2 cycles
        LD    (C), A          ; 2 cycles
        LD    A, (HLI)        ; 2 cycles
        LD    (C), A          ; 2 cycles
;
        DEC   B
        JR    NZ, __LOOP
```

Using this routine, CPU 26 will require 8 cycles to update each color in a palette. If we need to change 16 colors (four palettes of four colors each), CPU 26 will require at least 128 cycles. Unfortunately, as discussed above, the horizontal blanking interval lasts only 110 cycles. Thus, there is insufficient time.

Figure 3A:
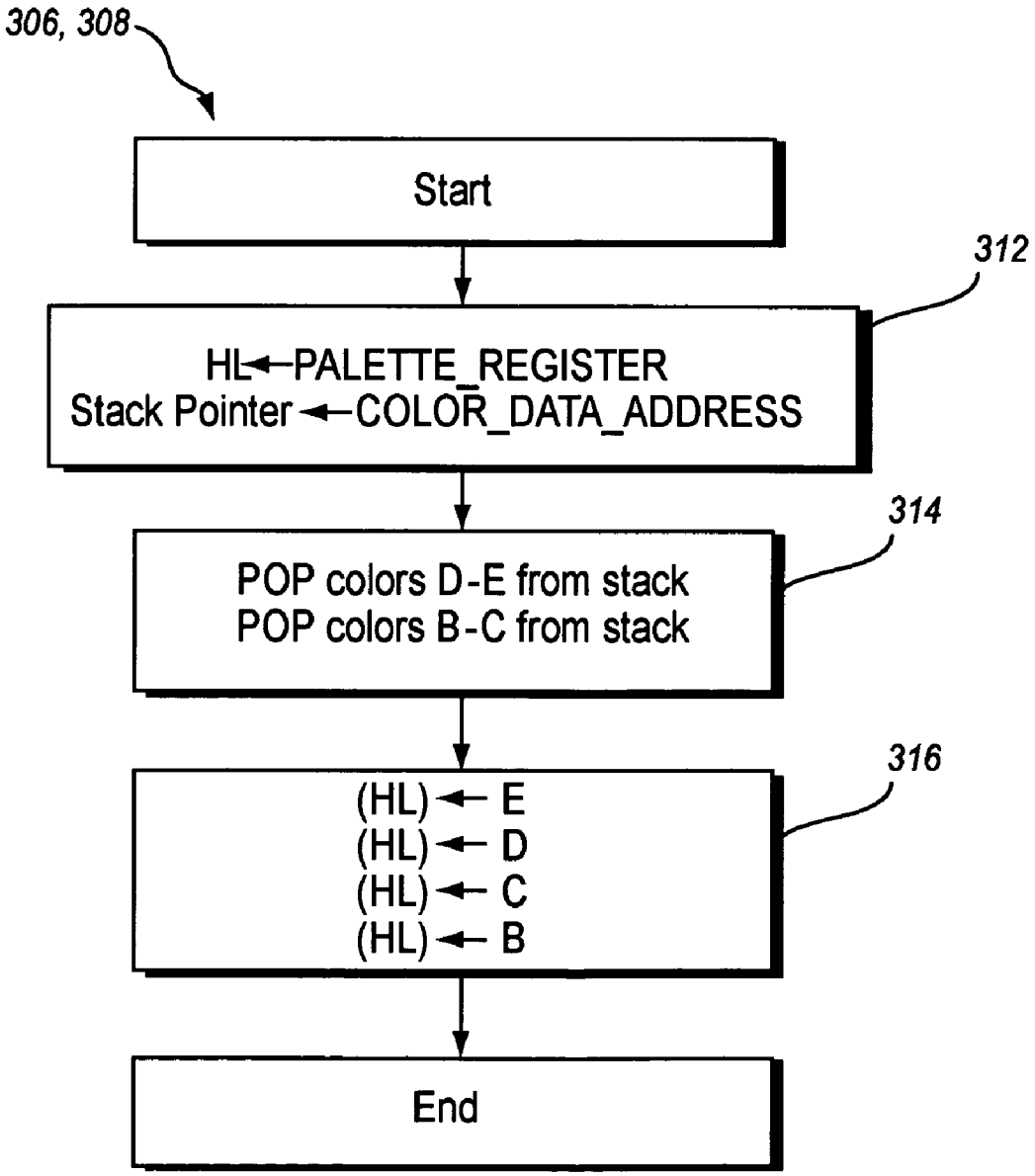
FIG. 3A is a flowchart of example assembly language coding provided in accordance with a preferred embodiment of this invention for efficiently updating color palette data.

In order to update as many as possible colors, we need to optimize our code to speed up the processing. One way to do this is to set the stack pointer to the address of color data, and use stack "Pop" operations to "pop" the color data which can then be written directly to internal RAM 34. A flowchart of such an assembly language copy routine 306, 308 is shown in FIG. 3A. Briefly, block 312 sets a pointer HL to the address of the appropriate portion of the color palette area 34*b* in memory 34, and sets the stack pointer SP to the address in memory of the color data to be copied into the color palette area. Such setup can be performed prior to receipt of an Hblank interrupt. Upon receipt of the interrupt, routine 306, 308 can use the POP command (block 314 ) to pop the color data for four colors into CPU registers B, C, D, B from a "stack" of such color data in memory, and use indirect LD instructions to load the contents of these four registers into the color palette area locations indexed by HL (block 316 ). The following is an example assembly language coding for the FIG. 3A routine:

```
        LD    HL, PALETTE_REGISTER
        LD    SP, COLOR_DATA_ADDRESS
;
        POP   DE              ; 3 cycles
        POP   BC              ; 3 cycles
        LD    (HL), E         ; 2 cycles
        LD    (HL), D         ; 2 cycles
        LD    (HL), C         ; 2 cycles
        LD    (HL), B         ; 2 cycles
;
        . . .
```

In this case, CPU only takes 112 cycles to update the 16 colors comprising 4 palettes. This means that during about 110 cycles of the Horizontal Blank period, we are able to update all 4 palettes.

Optimal Conversion from Bitmapped to Character Format

Even with the use of the FIG. 3 interrupt routine, the hardware limitations of system 10 constrain the number of background colors that can be displayed in any given line to a maximum number of 32 different colors. Furthermore, because of the timing limitations discussed above, it is possible to completely change the background color palette information only once every other line. However, because the preferred embodiment of the present invention allows the background color palettes to be completely updated once every other line, the 32 background colors displayed within any given group of two lines on display 16 can be different (within the timing limitations discussed above) from the background colors displayed in the preceding two lines.

We have found that by carefully converting source photographic images to character mapped format for use with system 10, we can achieve very rich and visually pleasing photographic quality image displays on LCD display 16 despite these inherent limitations.

Figure 4:
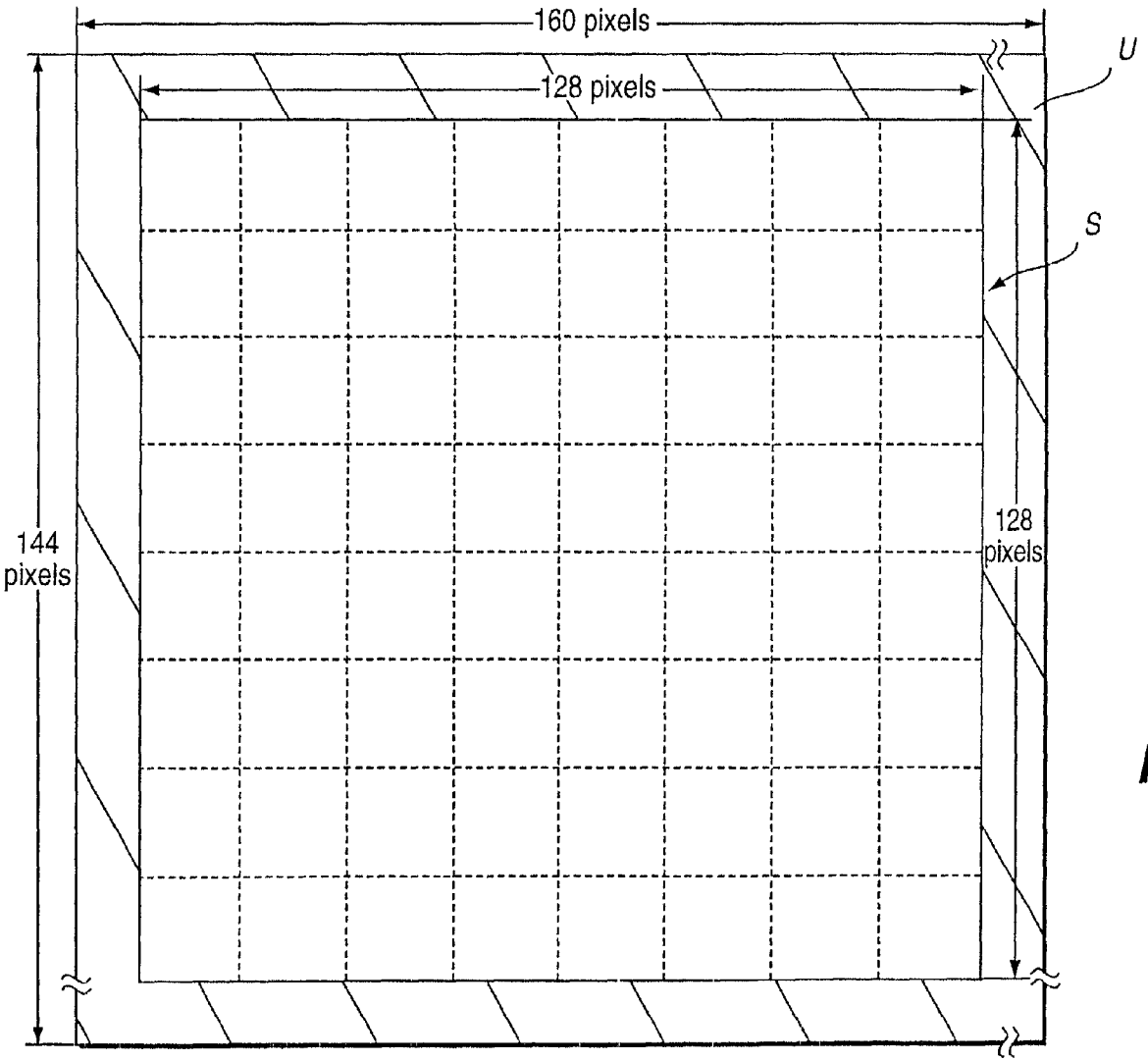
FIG. 4 is an example technique provided in accordance with a preferred embodiment of this invention for using an optimal subset of the LCD display area of the FIG. 1 system.

FIG. 4 shows one aspect of the conversion process we use. Even though the LCD display 16 of system 10 has a rectangular size of 160 pixels by 144 pixels, we choose to use only a square subset S of this display area that is 128 pixels high by 128 pixels wide. In the preferred embodiment, the unused portion U of LCD 16's display area may be displayed as a black border if desired.

System 10 handles the subset S as a square background character map comprising eight 8-by-8 tiles wide by eight 8-by-8 tiles high (for a total of 64 tiles each comprising 64 pixels). See FIG. 4. However, our conversion technique subdivides this character map differently—by subdividing the same square 16,384 pixel space into 512 tiles each 16 pixels wide by 2 pixels high (see FIG. 5). This means that each pair of horizontal lines will comprise eight 16-pixel by 2-pixel tiles. By associating a different 4-color palette with each 16-pixel by 2-pixel tile, 8 different palettes are associated with every pair of horizontal lines of the image. Since each 16-pixel by 2-pixel tile can have 4 unique colors, this gives us 2048 colors that can be simultaneously displayed on LCD display 16.

Typically, photographic and photorealistic images do not include abrupt changes between neighboring pixels. In such images, neighboring pixels typically exhibit colors that are usually quite close to one another. We have discovered that with careful selection, it is often possible to arrive at a set of 32 colors (i.e., four color palettes worth of data) that will acceptably display a group of two adjacent lines without noticeable color resolution degradation. Furthermore, even if some part of the first line is using the color palettes from the previous line, the overall graphic display will still exhibit sufficient color resolution to be pleasing and rich to the human eye. In more detail, because the preferred embodiment routine described above can update only half of the eight background color palettes prior displaying the next set of two lines, half of next line will be rendered using the color palettes remaining from the previous set of two lines. While this can introduce color errors, we have found that such errors are not usually objectionable because color changes across a photographic image are typically gradual rather than abrupt. This means that the colors within successive lines of an image are generally relatively close to one another in value, and that rendering half of a line based on the color palettes of the just-previous line will usually not introduce obviously objectionable color error. We have developed an optimal image conversion technique that takes advantage of these factors to produce high quality color rich images for display on LCD display 16.

Figure 5:
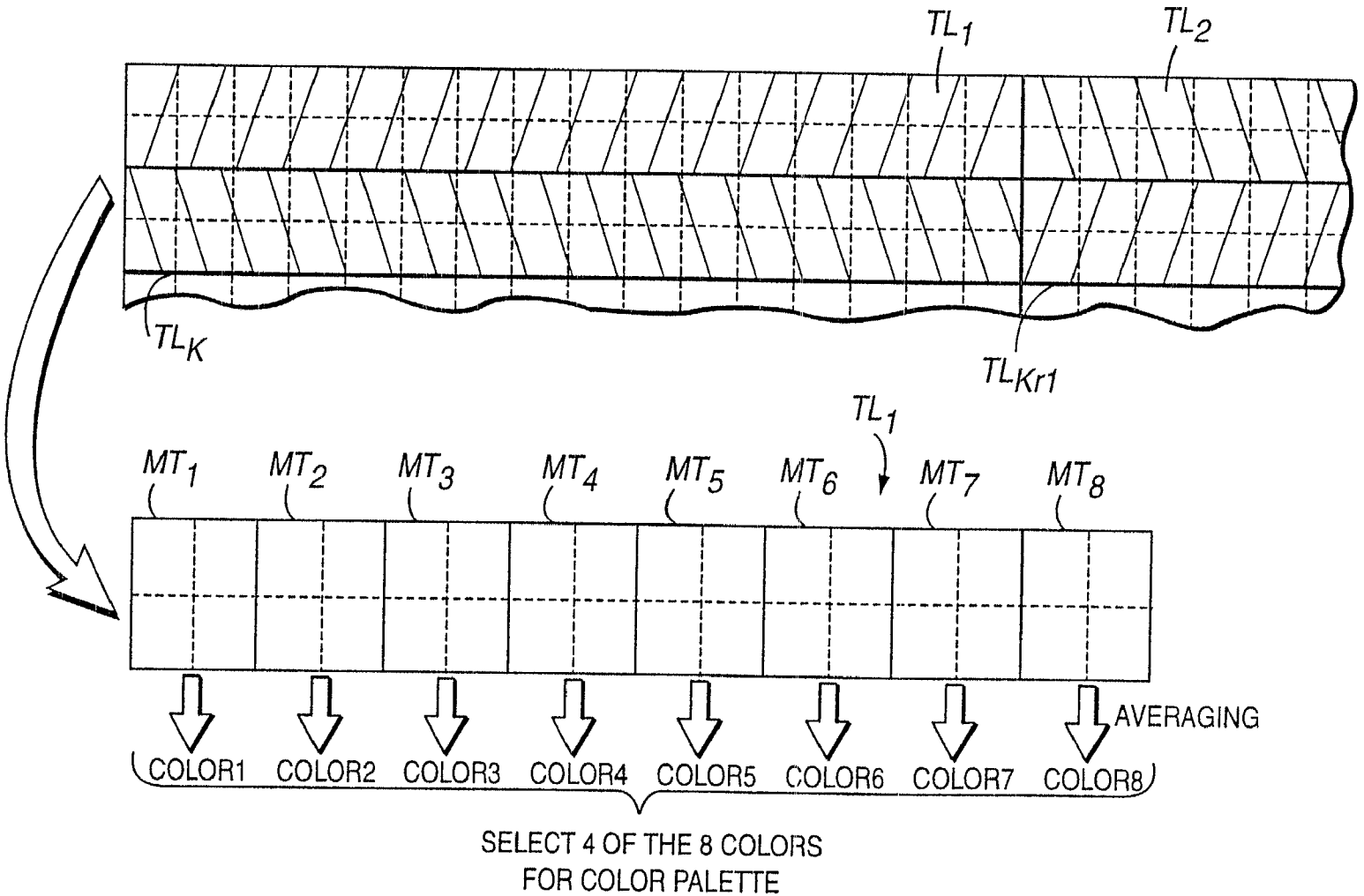
FIG. 5 schematically shows an example of how a preferred embodiment of this invention converts the color values of an arbitrary source image into a color-reduced character-mapped format that can be displayed by the FIG. 1 system.
Figure 6:
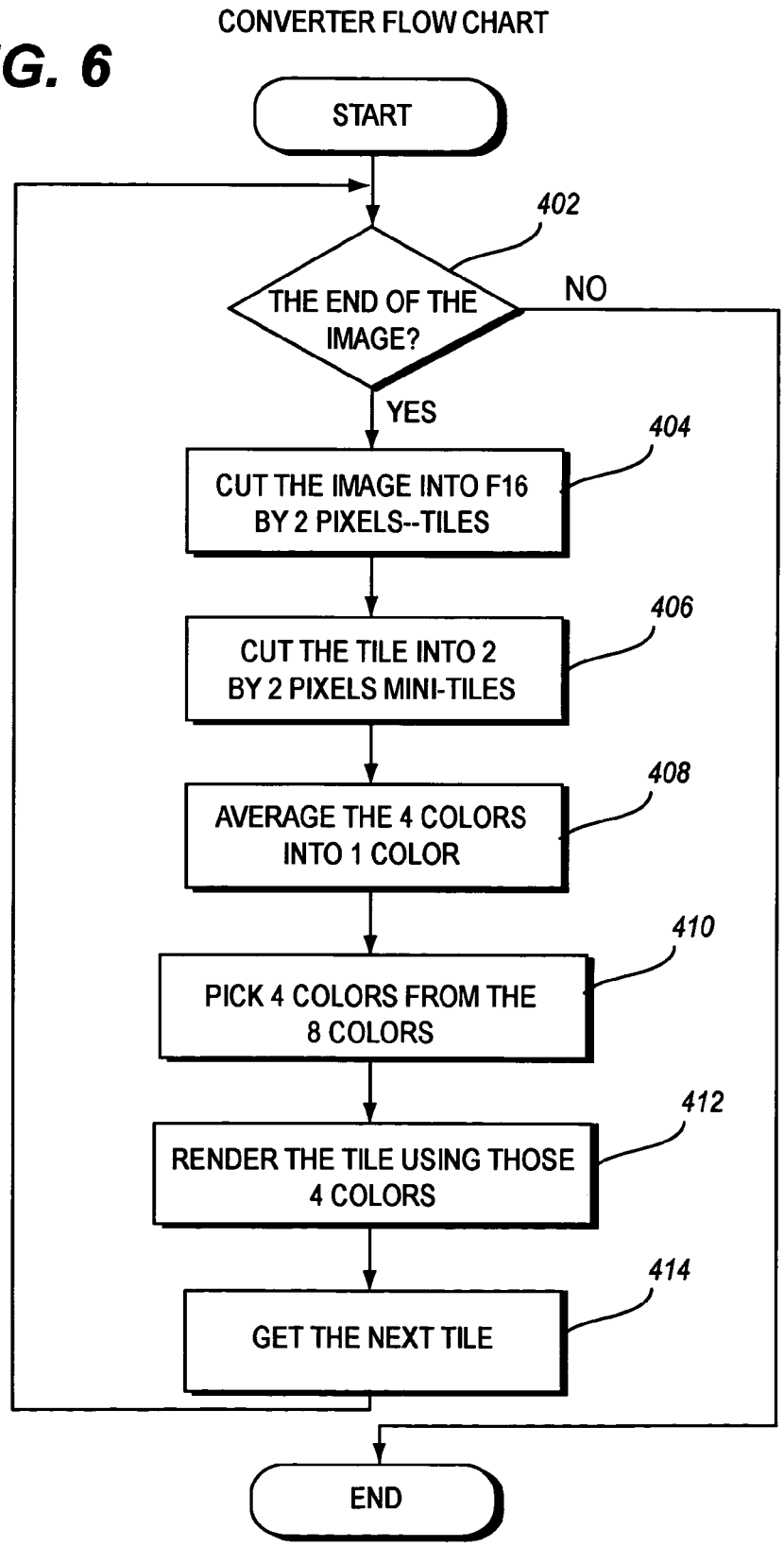
FIG. 6 is a flowchart illustrating example program controlled steps for performing the operations shown in FIG. 5.

As shown in FIGS. 5 & 6, the preferred embodiment of our color converter divides the source image into 16-pixel by 2-pixel tiles TL (FIG. 6, block 404), and then subdivides each tile TL into eight 2-pixel by 2-pixel mini-tiles MT (FIG. 6, block 406). We then average the 4 colors of each mini-tile MT together into a single color for each mini-tile (FIG. 6, block 408). Each 16-pixel by 2-pixel tile TL thus gives us 8 different color values (see FIG. 5). Because each background color palette of system 10 provides only four different color values, we reduce these 8 color values to 4 color values (FIG. 6, block 410) using a closest color color-reduction method, and render the 16-pixel by 2-pixel tile using those 4 colors (FIG. 6, block 412). We perform this process until an entire source image has been converted (blocks 402, 414).

To implement the color reduction process of FIG. 6 block 410, we prefer to use a closest color reduction process based on Euclidean distance in a three-dimensional color coordinate system. In more detail, when we have several colors in a palette and we are trying to find out which palette color is closest to the pixel we are trying to render, we visualize each color as a position in a 3D color space (for example, the red value being defined along the X coordinate, green value being defined along the Y coordinate, and blue value being the Z coordinate of a 3D Cartesian coordinate system). Colors that are most similar to each other will have a minimum geometric (Euclidean) distance between each other in the 3D space. To find out how close one color is to another we can use the 3D-distance formula:

$$D^2=(R2-R1)^2+(G2-G1)^2+(B2-B1)^2$$

We use this color-distance calculation to optimally determine which four of the eight potential color palette data values we obtain from averaging the 2-pixel by 2-pixel minitiles MT that should be assigned as color palette data. We then use a similar color-distance calculation to determine which of the four color values selected for the color palette should be assigned to each of the 32 pixels within the corresponding 16-pixel by 2-pixel tile TL.

Figure 6A:
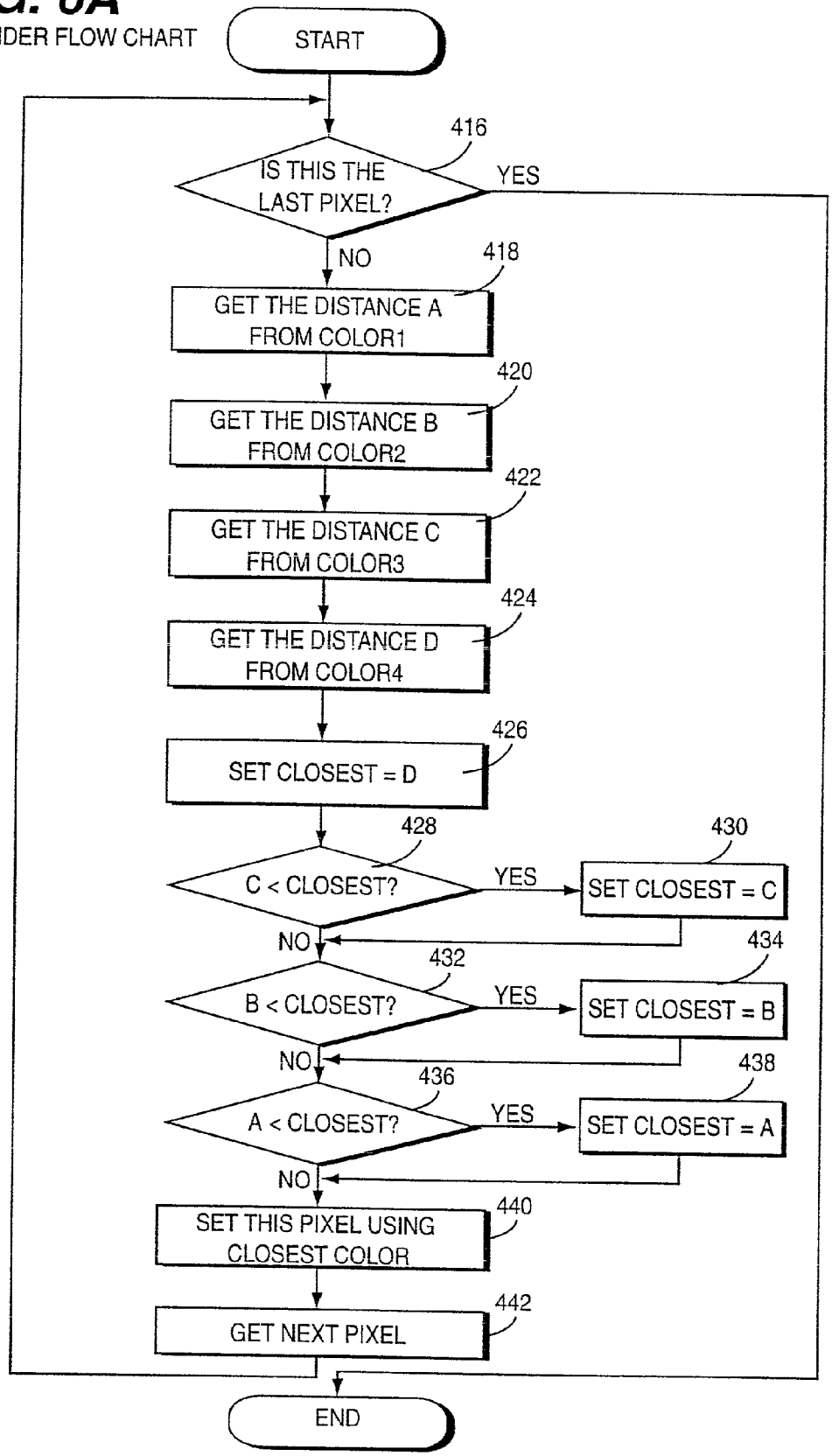
FIG. 6A is a flowchart of example program controlled steps provided in accordance with a preferred embodiment of this invention for selecting an optimal color for a particular source image pixel from a color palette of four color values.

FIG. 6A is a flowchart of example program control steps for implementing our closest color reduction method for rendering a particular pixel by selecting which of four color values within a color palette should be assigned to a particular pixel. The FIG. 6A routine is performed for each pixel in the source image (blocks 416, 442). For a given source pixel, the FIG. 6A routine calculates the color distance (i.e., the Euclidean distance in 3D color space) between the source pixel color value and each of the four color values within color palette corresponding to the 16-pixel by 2-pixel tile MT (blocks 418, 420, 422, 424). Suitable if/then or "case" logic then determines which of the four calculated distances is the smallest, i.e., which of the four palette values is "closest", based on Euclidean distance in 3D color space, to the actual source pixel color value (blocks 426–438). The pixel value in the character-mapped output image is assigned to the one of the four color palette values that is closest (block 440).

EXAMPLE RESULTS

Figure 7A:
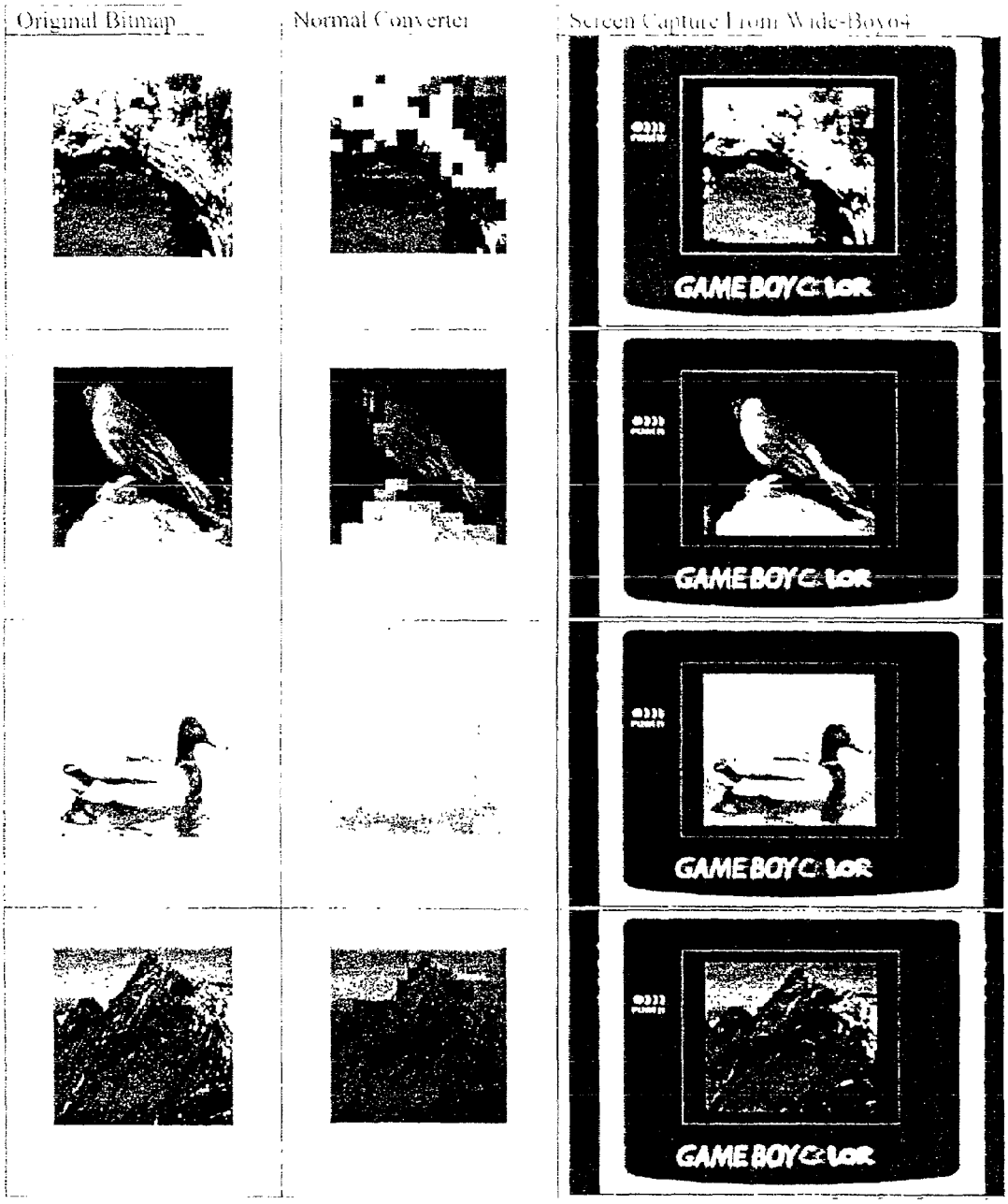
FIGS. 7A–7C show example results obtained by a preferred embodiment of the invention.
Figure 7B:
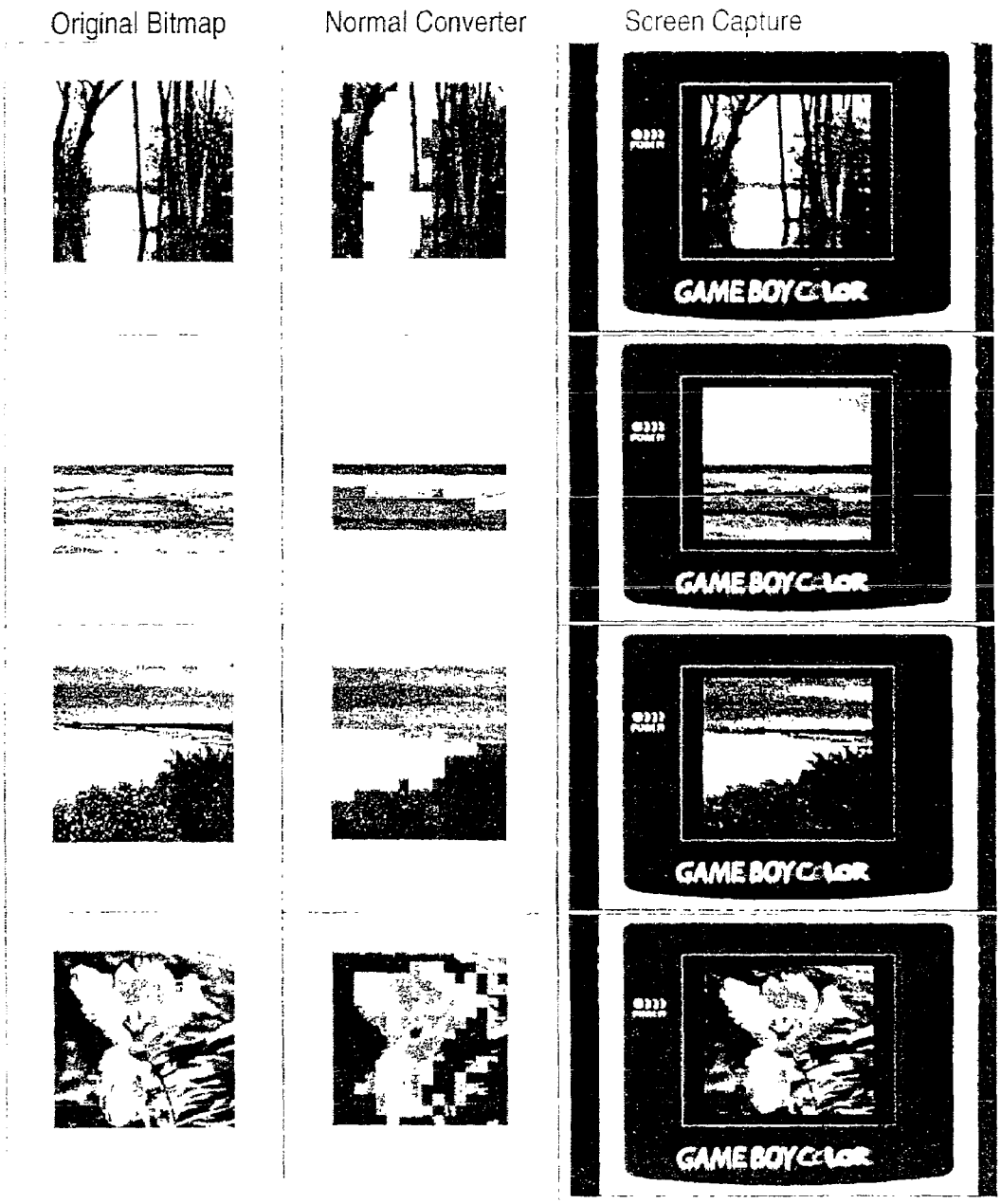
Figure 7C:
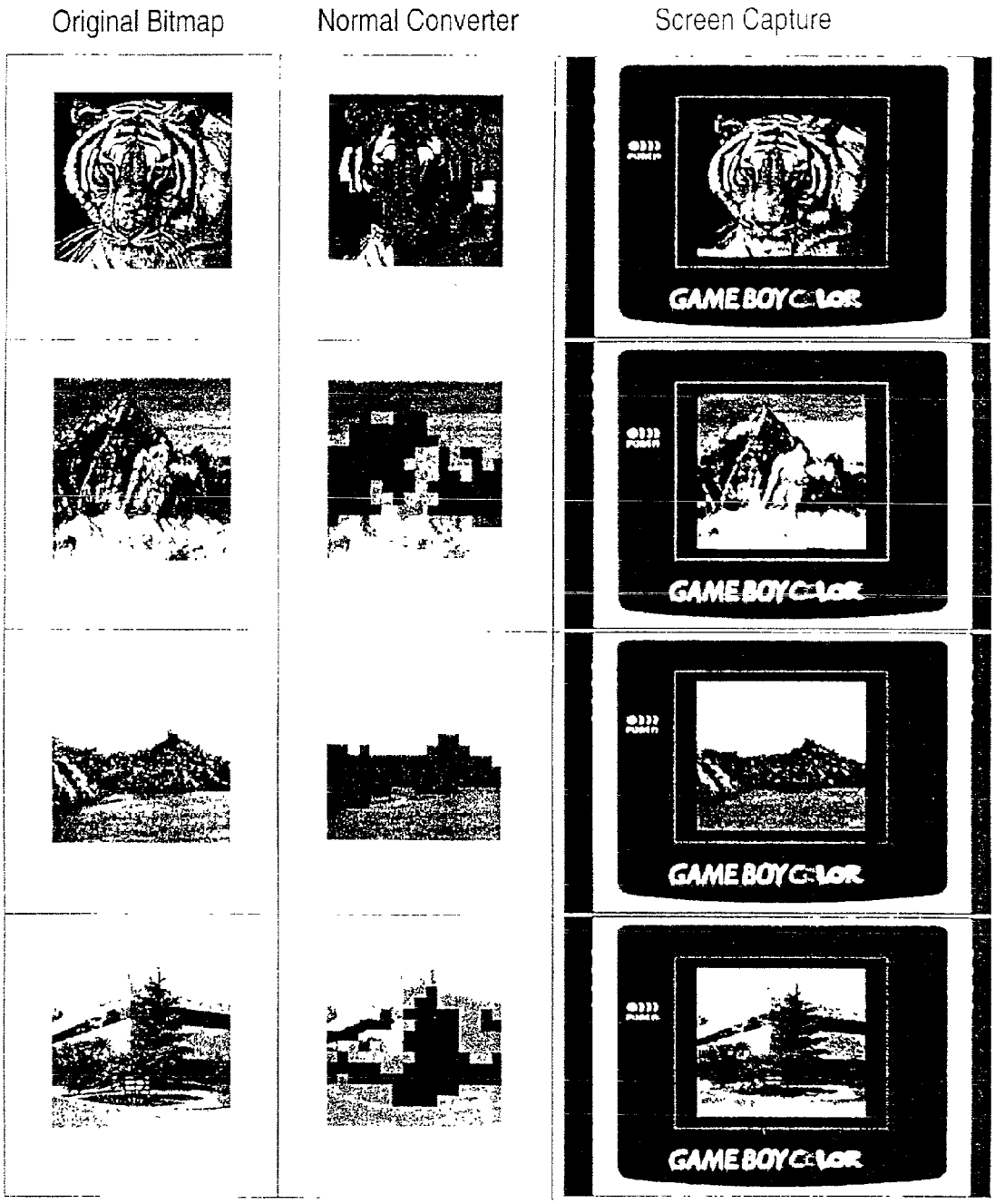

FIGS. 7A–7C show actual examples of results provided by a preferred embodiment of this invention. In these figures, the left column shows the original source image; the middle column shows the result that might be obtained using conventional methods to convert to Game Boy Color format; and the right column shows results obtained by the present invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the scope of the appended claims.

We claim:

1. A storage medium that stores code for execution by a handheld computing device of the type including a color display having plural lines and display hardware that generates a horizontal line of a color image on said color display during a display interval based at least in part on color mapping data stored in a color memory, said display interval including non-display intervals between line display intervals, said color mapping data encoding a maximum number N of different colors that can typically be displayed on said color display simultaneously, said stored code providing:

a first routine that processes at least some user input and controls said display hardware to display colors on the display lines of said display; and a second routine responsive at least in part to said user input accepted and processed by said first routine, said second routine, in use, updating only a portion of said stored color mapping data during any non-display intervals between line display intervals while nevertheless effectively increasing the number of said colors that can be simultaneously displayed on said color display as compared to display where the stored color mapping data is not updated during said display interval, said second routine updating said stored color mapping data such that each color mapping data update applies to plural display lines of said display and colors of said plural display lines are responsive to said plural color updates performed during different non-display intervals between line display intervals, said storage medium further storing information defining said plural display lines that are color-reduced using a closest color color-reduction technique to allow said plural display lines to be color mapped using color updates written for previously-displayed image portions.

2. The storage medium of claim 1 wherein said display hardware periodically generates horizontal blanking intervals within said display interval, and said second routine updates said stored color mapping data during said horizontal blanking intervals.

3. The storage medium of claim 2 wherein said second routine updates only a portion of said color mapping data during each horizontal blanking interval.

4. The storage medium of claim 1 wherein said second routine uses a stack POP instruction to retrieve color mapping data for copying into said color memory.

5. The storage medium of claim 1 wherein said display hardware maps characters into display data, and said second routine updates said color mapping data in synchronism with said character data mapping to apply each said color mapping data update to only portions of said mapped characters.

6. The storage medium of claim 1 wherein said color display has a predetermined display area having a first shape, and said second routine updates color mapping data for only a subset of said predetermined display area having a second shape different from said first shape.

7. The storage medium of claim 1 wherein said display hardware maps characters into display data, and said second routine permits said display hardware to display high resolution quality images on said display.

8. The storage medium of claim 1 wherein said color memory stores N colors for display in the same display frame, and said second routine permits said display system to display more than 30×N colors in the same display frame.

9. The storage medium of claim 1 wherein said storage medium is disposed within an external memory cartridge.

10. A storage medium that stores code for execution by a handheld computing device of the type including a color display having plural lines and display hardware that generates a horizontal line of a color image on said color display during a display interval between vertical blanking periods based at least in part on color mapping data stored in a color memory, said color mapping data encoding a maximum number N of different colors that can typically be displayed on said color display simultaneously, said stored code providing:

a first routine that processes at least some user input and controls said display hardware to display colors on the display lines of said display; and a second routine responsive at least in part to said user input accepted and processed by said first routine, said second routine, in use, updating at least a portion of said stored color mapping data during said display while nevertheless effectively increasing the number of said colors that can be simultaneously displayed on said color display as compared to display where the stored color mapping data is not updated during said display interval, said second routine updating said stored color mapping data such that each color mapping data update applies to plural display lines of said display and colors of said plural display lines are responsive to plural color updates, wherein said second routine copies, into said color memory during each horizontal blanking interval, plural color palettes each providing plural colors.

11. A color-mapped display system comprising:

a color display, a display driver coupled to said color display, said display driver using color data to generate a color image on the color display during display scanning, a non-volatile memory that stores a routine for rewriting only a portion of stored color data during any given non-display period of said display scanning for use by the display driver to increase the effective color resolution of said system, and a further memory that stores image data subdivided into color-reduced subdivisions accessed between said non-display periods of said display scanning, each said subdivision comprising plural lines that have been color-reduced using a closest color color-reduction technique to allow color mapping using different color palettes rewritten during different non-display intervals, each said subdivision being associated with at least one corresponding common stored color data rewrite, said subdivisions being color-reduced to permit portions of said subdivisions to be displayed using color updates written for previously-displayed subdivisions.

12. The system of claim 11 wherein said display driver periodically generates a horizontal blanking interval, and said rewriting routine rewrites said color data during said horizontal blanking interval.

13. The system of claim 11 wherein said rewriting routine controls said system to rewrite only a portion of said color data during each non-display interval.

14. The display system of claim 11 wherein said subdivisions are color reduced based on Euclidean distance in a three-dimensional color coordinate system.

15. In a handheld device including a color liquid crystal display that displays lines of pixels within a time period between refreshes of the color liquid crystal display, horizontal blanking intervals occurring between display of successive ones of said lines of pixels, said time period between said color liquid crystal display comprising a first horizontal blanking interval and a further horizontal blanking interval, said device further including color display circuitry that color maps graphics information for display based on a stored color memory storing plural color palettes, a method comprising:

(a) rewriting only a portion of said color memory during said first horizontal blanking interval;

(b) displaying a first set of color-reduced plural lines of pixels based on said colors written by said step (a);

(c) rewriting further colors to said color memory during said further horizontal blanking interval; and (d) displaying a second set of color-reduced plural lines of pixels based on the combination of said colors written by said steps (a) and (c)

wherein the method further includes reducing the colors of at least said second set of plural lines of pixels using a closest color color-reduction technique so said combination of colors written by said steps (a) and (c) can be used to color map said color-reduced second set of plural lines, said color reducing including color-reducing image subdivisions to permit portions of said subdivisions to be displayed using color updates written for previously-displayed subdivisions.

16. The method of claim 15 wherein step (a) is performed during a horizontal blanking interval immediately preceding said line displayed by step (b), and step (c) is performed during a horizontal blanking interval immediately following said line displayed by step (b) and immediately preceding said line displayed by step (d).

17. The method of claim 15 wherein step (b) displays a maximum of half of said line based on said colors written by step (a), and step (d) displays all of said further line based on colors written by steps (a) and (c).

18. The method of claim 15 wherein steps (a) and (c) together rewrite all background color palettes within said color memory over two successive horizontal blanking intervals.

19. The method of claim 15 wherein said second set of plural lines are color reduced based on Euclidean distance in a three-dimensional color coordinate system.

20. A storage medium that stores code for execution by a handheld computing device of the type including a color display having plural lines and display hardware that generates a horizontal line of a color image on said color display during a display interval between vertical blanking periods based at least in part on color mapping data stored in a color memory, said display interval including horizontal blanking intervals, said color mapping data encoding a maximum number N of different colors that can typically be displayed on said color display simultaneously, said stored code providing:

a first routine that processes at least some user input and controls said display hardware to display colors on the display lines of said display; and a second routine responsive at least in part to said user input accepted and processed by said first routine, said second routine, in use, updating only a portion of said stored color mapping data during any given horizontal blanking interval of said display interval while nevertheless effectively increasing the number of said colors that can be simultaneously displayed on said color display as compared to display where the stored color mapping data is not updated during said display interval, said second routine updating said stored color mapping data such that each color mapping data update applies to plural display lines of said display and colors of said plural display lines are responsive to said plural color updates performed during different horizontal blanking intervals, said storage medium further storing information defining said plural display lines that are color-reduced using a closest color color-reduction technique to allow said plural display lines to be color mapped using plural color updates performed during said different horizontal blanking intervals, wherein said stored information defining said image is subdivided into two-line subdivisions each color reduced based on Euclidean distance in a three-dimensional color coordinate system.

21. A storage medium that stores code for execution by a handheld computing device of the type including a color display having plural lines and display hardware that generates a horizontal line of a color image on said color display during a display interval between vertical blanking periods based at least in part on color mapping data stored in a color memory, said display interval including horizontal blanking intervals, said color mapping data encoding a maximum number N of different colors that can typically be displayed on said color display simultaneously, said stored code providing:

a first routine that processes at least some user input and controls said display hardware to display colors on the display lines of said display; and a second routine responsive at least in part to said user input accepted and processed by said first routine, said second routine, in use, updating only a portion of said stored color mapping data during any given horizontal blanking interval of said display interval while nevertheless effectively increasing the number of said colors that can be simultaneously displayed on said color display as compared to display where the stored color mapping data is not updated during said display interval, said second routine updating said stored color mapping data such that each color mapping data update applies to plural display lines of said display and colors of said plural display lines are responsive to said plural color updates performed during different horizontal blanking intervals, said storage medium further storing information defining said plural display lines that are color-reduced using a closest color color-reduction technique to allow said plural display lines to be color mapped using plural color updates performed during said different horizontal blanking intervals, wherein said subdivisions are color reduced to permit portions of said subdivisions to be displayed using color updates written for previously-displayed subdivisions without introducing objectionable color error.

22. A color-mapped display system comprising:

a color display, a display driver coupled to said color display, said display driver using color data to generate a color image on the color display during display scanning, a non-volatile memory that stores a routine for rewriting only a portion of stored color data during any given horizontal blanking period of said display scanning for use by the display driver to increase the effective color resolution of said system, and a further memory that stores image data subdivided into color-reduced subdivisions accessed between said horizontal blanking periods of said display scanning, each said subdivision comprising plural lines that have been color-reduced using a closest color color-reduction technique to allow color mapping using different color palettes rewritten during different horizontal blanking intervals, each said subdivision being associated with at least one corresponding common stored color data rewrite, wherein said subdivisions are color reduced to permit portions of said subdivisions to be displayed using stored color data rewritten for previously-displayed subdivisions without introducing objectionable color error.

23. In a handheld device including a color liquid crystal display that displays lines of pixels within a time period between refreshes of the color liquid crystal display, horizontal blanking intervals occurring between display of successive ones of said lines of pixels, said time period between said color liquid crystal display comprising a first horizontal blanking interval and a further horizontal blanking interval, said device further including color display circuitry that color maps graphics information for display based on a stored color memory storing plural color palettes, a method comprising:

(a) rewriting only a portion of said color memory during said first horizontal blanking interval;

(b) displaying a first set of color-reduced plural lines of pixels based on said colors written by said step (a);

(c) rewriting further colors to said color memory during said further horizontal blanking interval; and (d) displaying a second set of color-reduced plural lines of pixels based on the combination of said colors written by said steps (a) and (c)

wherein the method further includes reducing the colors of at least said second set of plural lines of pixels using a closest color color-reduction technique so said combination of colors written by said steps (a) and (c) can be used to color map said color-reduced second set of plural lines, wherein said second set of plural lines are color reduced to permit portions of said second set of plural lines to be displayed using color updates written for said first set of plural lines without introducing objectionable color error.

* * * * *